US007331705B1

(12) United States Patent
Liles

(10) Patent No.: US 7,331,705 B1
(45) **Date of Patent: *Feb. 19, 2008**

(54) STATIC DEVICE AND METHOD OF MAKING

(75) Inventor: John Kevin Liles, Ocala, FL (US)

(73) Assignee: Inflowsion L.L.C., Ocala, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/314,404

(22) Filed: Dec. 5, 2002

Related U.S. Application Data

(63) Continuation-in-part of application No. 10/167,791, filed on Jun. 10, 2002, now Pat. No. 7,264,394.

(51) Int. Cl.
*B01F 5/00* (2006.01)

(52) U.S. Cl. ..... 366/339

(58) Field of Classification Search ..... 366/336, 366/339, 338, 341; 138/38, 177, 122; 165/184
See application file for complete search history.

(56) References Cited

U.S. PATENT DOCUMENTS 525,061 A * 8/1894 Schmidt ..... 285/330
592,459 A * 10/1897 Wietzel ..... 138/154
650,575 A * 5/1900 Whitney ..... 138/38
770,599 A * 9/1904 Monteagle ..... 138/38
862,919 A * 8/1907 Isaacs et al. ..... 138/39
1,279,710 A 9/1918 Kirke
1,363,416 A * 12/1920 Hooker ..... 138/38
1,713,456 A * 5/1929 Strindlund ..... 165/163
1,853,045 A * 4/1932 Gnau ..... 261/76
1,995,791 A * 3/1935 Bonnot ..... 138/177
2,119,864 A * 6/1938 Kleucker ..... 62/98
2,252,045 A 8/1941 Spanner
2,425,298 A * 8/1947 Attridge et al. ..... 29/890.053
2,661,194 A 12/1953 Katovsich
2,744,391 A * 5/1956 Deane ..... 62/451
2,933,293 A * 4/1960 Ferrari, Jr. ..... 366/106
2,983,993 A * 5/1961 Johnson ..... 29/890.042
2,983,994 A * 5/1961 Johnson ..... 29/890.042
3,337,194 A 8/1967 Zavasnik et al.
3,343,250 A * 9/1967 Goforth et al. ..... 29/890.053
3,460,809 A 8/1969 Hauss
3,463,011 A * 8/1969 Wehde et al. ..... 73/742
3,553,976 A * 1/1971 Cumine et al. ..... 165/169
3,578,075 A * 5/1971 Winter ..... 165/177
3,612,175 A 10/1971 Ford et al.
3,632,090 A 1/1972 White
3,647,187 A 3/1972 Dannewitz et al.
3,664,638 A 5/1972 Grout et al.
3,762,468 A * 10/1973 Newson et al. ..... 165/177
3,800,985 A 4/1974 Grout et al.
3,908,702 A 9/1975 Klosse et al.

(Continued)

*Primary Examiner*—Tony G. Soohoo
(74) *Attorney, Agent, or Firm*—Frijouf Rust & Pyle P.A.

(57) ABSTRACT

A static device and method of making is disclosed for mixing matter flowing therethrough. The invention comprises a tube having a polygonic cross section defining a plurality of corners. The tube is spirally twisted with the plurality of corners forming a plurality of helixes for causing the matter flowing through the tube to rotate in accordance with the plurality of helixes. A center section of the spirally twisted tube is formed in an arc having an arc center disposed normal to said axis of said twisted tube.

3 Claims, 8 Drawing Sheets

U.S. PATENT DOCUMENTS 3,951,813 A 4/1976 Palma
4,072,296 A 2/1978 Doom
4,093,188 A 6/1978 Horner
4,111,402 A 9/1978 Barbini
4,112,520 A 9/1978 Gilmore
4,165,360 A * 8/1979 Casper et al. ..... 366/341
4,179,222 A 12/1979 Strom et al.
4,259,024 A 3/1981 Clasen et al.
4,264,212 A 4/1981 Tookey
4,305,460 A * 12/1981 Yampolsky ..... 138/38
4,422,773 A * 12/1983 Cassaday et al. ..... 366/341
4,462,903 A 7/1984 Wettengl
4,511,258 A 4/1985 Federighi et al.
4,576,714 A 3/1986 Pohoreski
4,599,773 A * 7/1986 Sievers ..... 29/890.035
4,688,319 A 8/1987 Gross et al.
4,710,290 A 12/1987 Briltz
4,840,493 A 6/1989 Horner
4,865,460 A 9/1989 Friedrich
4,929,088 A 5/1990 Smith
4,936,689 A 6/1990 Federighi et al.
4,981,368 A 1/1991 Smith
5,013,429 A 5/1991 Krofta
5,069,881 A 12/1991 Clarkin
5,120,436 A * 6/1992 Reichner ..... 210/207
5,145,256 A 9/1992 Wiemers et al.
5,193,588 A 3/1993 Kanao
5,248,421 A 9/1993 Robertson
5,326,537 A * 7/1994 Cleary ..... 422/173
5,330,267 A 7/1994 Tauscher
5,551,504 A 9/1996 Zifferer
5,567,390 A * 10/1996 Cleary ..... 422/111
5,695,645 A 12/1997 Bober et al.
5,758,695 A 6/1998 Carson
5,800,059 A 9/1998 Cooke et al.
5,960,870 A 10/1999 Takahashi et al.
6,280,615 B1 8/2001 Phillips et al.
6,331,072 B1 * 12/2001 Schierholz et al. ..... 366/338
6,332,980 B1 12/2001 Moorehead
6,346,197 B1 2/2002 Stephenson et al.
6,368,511 B1 4/2002 Weissenberg et al.
6,387,274 B1 5/2002 Hendricks et al.
6,395,175 B1 5/2002 Gao et al.
6,419,831 B2 7/2002 Wang
6,454,949 B1 9/2002 Sesay et al.
7,041,218 B1 * 5/2006 Liles ..... 210/512.1
7,045,060 B1 * 5/2006 Liles et al. ..... 210/199

* cited by examiner

STATIC DEVICE AND METHOD OF MAKING

CROSS-REFERENCE TO RELATED APPLICATIONS

This is a continuation-in-part of U.S. patent application Ser. No. 10/167,791 filed Jun. 10, 2002 now U.S. Pat. No. 7,264,394. All subject matter set forth in application Ser. No. 10/167,791 is hereby incorporated by reference into the present application as if fully set forth herein.

BACKGROUND OF THE INVENTION

1. Field of the Invention

This invention relates to mixing of matter and more particularly to an improved static mixer.

2. Background of the Invention

The art of mixing comprises the agitation, distribution, intermingling, and homogeneity of matter. Agitation of matter with the intent to blend is specifically considered to be mixing. Other processes which depend upon and are promoted by agitation and mixing include chemical reactions, heat transfer, dispersion and mass transfer, including both solubility and crystallization. The type, extent and intensity of mixing determine both the process rate and adequacy of the mixing. In all mixing processes, energy must be added in order to effect mixing. Mixing is accomplished by a variety of equipment. Typical of this equipment is the impeller mixer generally used in a closed container and in a batch mixing process. In a continuous mixing process, pipeline blending is a commonly used mixing method. In some continuous process mixing systems, a baffled mixing cell is provided with one or two impellers on a powered shaft.

Static mixers comprise a group of devices comprising motionless devices. These pipe based devices generally contain internal baffles or other devices requiring no external energy to produce a turbulent flow in the pipe other than the energy required to move the matter through the pipe system. Subsequent mixing of the matter therein occurs as the matter is in transit through the pipe system. However, the internal baffles and internal turbulent flow producing devices require additional energy to be applied to the matter traversing the static mixer. The internal baffles also create a non-uniform pressure drop between the inlet and outlet of the system. Additionally, the internal baffles and other internal turbulent flow producing devices may become obstructions to flow. Clean up of these devices when mixing or reacting certain kinds of matter can present significant problems such as polymeric reactions, mixtures of viscous materials and the like. A variety of static mixers has been described in the literature.

U.S. Pat. No. 2,252,045 to Edward Frank Spanner discloses an invention concerned with tubular heat exchange apparatus in which heat transfer is required between hot and cold fluids, and in which the hot fluid i.e. gas or liquid is passed from an inlet chamber to an outlet chamber through a multiplicity of straight tubes expanded into tube plates at the ends of a shell containing or confining the cold fluid i.e. gas or liquid, to which heat is to be transferred.

U.S. Pat. No. 3,337,194 to Zavasnik et al. discloses an in-line blender for particulate materials comprising in combination an elongated chamber having provided therein a plurality of baffle means each so adapted as to partially traverse said chamber thereby obstructing the path flow of solids at one or more points within said chamber.

U.S. Pat. No. 3,612,175 to Ford et al. discloses an improved corrugated metal tubing having an improved heat-transfer coefficient and having a plurality of lands and grooves extending along the circumference thereof. The grooves comprise at least two independent, continuous grooves extending helically along the circumference of the tube, with each groove being in spaced relationship to each other. Improved heat transfer is obtained by providing that the land width, the groove width and the angle of advance of the helically extending grooves are related in a particular defined manner.

U.S. Pat. No. 3,647,187 Dannewitz et al. discloses a static mixer and method of making the same which mixer is capable of simultaneously mixing together a plurality of fluids, usually at least two liquids, in a stream which may be segmented by a fluid which may be a gas, comprising one or more elements forming an elongated fluid passageway for conveying the fluids while at least two liquids are intermixed. A helix is formed within the passageway to impart a rotational movement to the stream so that the rotational velocity at the liquid-wall interface is greater than that at the center of the stream, providing an efficient mixing action, without breaking up the gas segments.

U.S. Pat. No. 3,664,638 to Grout et al. discloses a device for thoroughly mixing components of a fluidic material flowing through a conduit which contains a plurality of curved sheet-like elements extending longitudinally through the conduit in which consecutive elements arc curved in opposite directions and the adjacent edges of consecutive elements are spaced from each other by a distance dependent on the Reynolds number of the fluid and angularly displaced with respect to each other by an angle 20 which differs from 90° by an amount dependent on said distance.

U.S. Pat. No. 3,800,985 to Grout et al. discloses a system for distributing a highly viscous molten material such as a molten polymer. The system includes means for heating the material to a molten state and moving it through a special mixing structure located just ahead of one or more output ports leading to a further processing system including a filament spinneret. The mixing structure includes a conduit containing—a plurality of sheet-like elements extending longitudinally within the conduit, each element being curved to turn the direction of the material flowing past it. The elements are arranged in alternating right and left-handed curvature groups (a group consisting of one or more elements). The conduit is in contact with a heat exchange medium to maintain the polymer at its proper molten temperature. A modification for distributing molten glass is also disclosed as being substantially the same as for the molten polymer.

U.S. Pat. No. 3,908,702 to Klosse et al. discloses portions of fluid components being mixed during transport through a tube by continuously disturbing their flow pattern in a controlled manner during their passage through the tube. The disturbance is created by providing the tube with a radially inward profile that an internal screw-thread of a thickness 0.25 to 0.75 times the internal diameter of the tube and having a pitch 0.75 to 1.5 times the internal diameter of the tube.

U.S. Pat. No. 4,072,296 to Lewis G. Doom discloses a motionless mixer including a number of baffles attached to a central rod is slidably mountable within a hollow cylindrical conduit. A cross member is attached across the interior of the conduit and is configured to mate with a slot formed in the downstream end of the central rod, to prevent longitudinal motion or rotation of the mixer within the conduit.

U.S. Pat. No. 4,093,188 to Terry A. Horner discloses two or more fluids, particularly viscous fluids, may be thoroughly blended and homogenized with a static mixer and method using a mixing element which comprises two or more banks of stationary baffles arranged around an axis parallel to the overall direction of flow of the fluids to be mixed. The baffles in each bank of the element are inclined at an angle to the overall flow axis and at an angle to the baffles of adjacent banks so that fluid streams are guided through windows or apertures formed by abutting baffles along the interface between adjacent banks. Each bank includes a plurality of substantially parallel baffle plates spaced along the axis, and at least one of the banks has a second set of substantially parallel baffle plates spaced along the axis and alternating with the first set of baffles. The baffles of the second set are inclined to the axis at an angle different from the inclination of the baffles of the first set so that alternately converging and diverging passages are formed between the baffles. By this means, fluid streams are successively and repeatedly subdivided, converged and redivided into a plurality of substreams in sinuous, non-parallel spiraling paths to effect a more thorough and efficient blending of the fluids than previously possible.

U.S. Pat. No. 4,112,520 to Oscar Patton Gilmore discloses a static mixer for streams of flowing materials comprising a flow passage defined in a laminated body having end plates and a number of intermediate plates all detachably interconnected to form a unitary structure. The flow passage flows a serpentine path, crossing and recrossing boundaries between the several plates. Mixing structures are formed in the passage for combining, dividing and recombining streams of flowing materials in the passage by means of rotation of flow path and altering the cross-sectional shape of the flow paths. Disassembly of the several plates of the laminated body permits easy access to individual sections of the flow passage to facilitate cleaning and repair. Flow passage sections extend along a path that bends about an axis perpendicular to the direction of flow therein to facilitate mixing and to achieve curvature of the path to enable it is cross and recross the several boundary surfaces between adjacent plates and the laminated body. Flow rotator sections are positioned in intermediate plates to provide a linear flow path. The mixer may employ unique multiple flow rotators either stacked alone or together with flow path bending sections.

U.S. Pat. No. 4,179,222 to Strom et al. discloses a device for generating special turbulence patterns in fluids flowing in pipes, such as for mixing, promoting chemical reactions, or accelerating the transfer of heat to or from the fluid through the pipe wall. Two or more sets of flow dividers are mounted in the pipe, each set including a first and second flow divider with septum panel elements that overlap longitudinally of the pipe. The first flow divider septum elements mutually diverge downstream in a selected longitudinal plane in longitudinally overlapping relationship with septum elements of the second flow divider mutually diverging upstream in a different longitudinal plane so as to divert the fluid in such manner that the flow regions adjoining the pipe wall are caused to exchange positions with flow regions in the vicinity of the pipe axis. By reversing the relative incline angles of the septum elements of corresponding flow dividers of successive sets alternately when a succession of two or more sets are installed in direct series, the desired effects are augmented.

U.S. Pat. No. 4,511,258 to Federighi et al. discloses a motionless mixing device including a conduit having a mixing element therein which is formed by deforming flat stock material. The mixing element includes two substantially identical segments or halves that each having a sinuous cross-section between opposite ends and are interconnected along the center of the conduit with the two segments being axially staggered with respect to each other.

U.S. Pat. No. 4,688,319 to Gross, et al. discloses a method for production of a multi-layer gap-less steel pipe. An inner pipe and an outer pipe are formed from thermomechanically rolled steel strip with high notched bar impact strength by welding. The individual helical welding seam steel pipes of about the same lengths are matched with a difference of less than about one percent between the outer diameter of the inner pipe and the inner diameter of the outer pipe. The matched inner pipe is inserted into the outer pipe and the pipes are mechanically expanded with diameter control to a preset outer diameter of the multi-layer steel pipe. The resulting multi-layer steel pipe has the inner pipe disposed under compression and the outer pipe layer disposed under stress. The presence of a compression stress in the inner pipe provides a means opposed to hydrogen sulfide stress corrosion. The advantages of the helical welding seam steel pipes can be combined such as economic production, advantages relating to crack formation and crack propagation stopping, and the availability of high internal pressure loads upon use of thin, economic steel strip of different yield strength.

U.S. Pat. No. 4,840,493 to Terry A. Horner discloses motionless mixers and baffles thereof and includes a baffle having a pair of substantially symmetric opposing major surfaces generally helically twisted along a central longitudinal axis of the baffle and a first substantially planar surface connecting the pair of major surfaces at one end of the baffle, the first planar surface extending both substantially transversely and substantially parallel to the central longitudinal axis. The intersection of the first planar surface and one of the major surfaces forms a knife-like edge at the one end of the baffle. Similar additional knife-like edges can be provided, a second knife-like edge on the one end of the baffle radially disposed on opposite sides of each of a pair of axes through a central longitudinal axis of the baffle to form leading edges of the baffle and a like pair of knife-like trailing edges on an opposite end of the baffle. Such geometry enables a plurality of the baffles to be formed as a single insert unit by conventional injection molding techniques using only a pair of mold halves.

U.S. Pat. No. 4,865,460 to Juergen Friedrich discloses a static mixing device comprising a conduit located a plurality of rows of spaced parallel tubes extending across the conduit. The tubes are located in rows in which the adjacent rows extend in a longitudinal direction, but are located at right angles to each other. The heat transfer medium flows through the tubes to maintain the product in the conduit within a preselected temperature range. The adjacent rows of tubes abut each other and thus provide a tortuous path for the product in the conduit to effect mixing thereof.

U.S. Pat. No. 4,929,088 to Charles R. Smith discloses a static mixing device adapted to be inserted in a fluid stream having a main flow direction with respect to a closed conduit, comprising at least two tabs inclined in the flow direction at a preselected elevation angle between 10 degrees and 45 degrees to the surface of the conduit. The tabs are spaced apart in a di-reaction transverse to the flow direction, the length and width of the tabs being selected so as to generate pairs of oppositely rotating predominantly streamwise vortices at the tips of each tab, and downstream hairpin vortices interconnecting adjacent streamwise vortices generated by a single tab.

U.S. Pat. No. 4,936,689 to Federighi et al. discloses a static material-mixing apparatus. The static material-mixing apparatus comprises a conduit having an axis and defining a chamber extending longitudinally therethrough opening on first and second ends of the conduit and a mixing element including two continuous segments in the chamber between the first and second ends, each having a generally sinuous cross-section between the first and second ends, the segments being disposed in radially spaced relationship with each other.

U.S. Pat. No. 4,981,368 to Charles R. Smith discloses a method and apparatus for generating tip vortices comprising a series of ramped tabs projecting inward at an acute angle from a bounding surface of a fluid containment and transport vessel such that the tabs are sloped in the direction of the fluid flow and spaced about the internal circumference of the bounding surface transverse to the main flow direction for causing vigorous cross-stream mixing through the generation of paired alternating rotation tip vortices from opposite sides of each tab with the vortices having their axes of rotation along the direction of the main flow. The vigorous cross-stream mixing will accomplish the equalization of various fluid properties such as velocity, thermal energy, kinetic energy and species concentration within the flow.

U.S. Pat. No. 5,069,881 to William J. Clarkin discloses a device and a method for the application of any adhesive. The device includes a hydraulically actuated mixhead which contains means to controllably deliver the components of a polyurethane based adhesive to the point of application of the adhesive and the means to separate between the components until the reaction between them is desired. Typically the components are in the form of streams and comprise an isocyanate stream and a polyol stream, the volume and flow velocity of each of which are in accordance within the invention hydraulically controlled.

U.S. Pat. No. 5,193,588 to Shiro Kanao discloses a pressure-resistant helical corrugated pipe comprising a helical corrugated pipe wall having a top portion, opposite side wall portions and a bottom portion. A continuous thin metal belt plate of a generally U-shaped transverse cross-section is disposed in one of the top portion and the bottom portion and also in at least part of the opposite side wall portions extending from the one of the top portion and the bottom portion. Another metal belt plate of a flat configuration is disposed in the other of the top portion and the bottom portion and disposed out of contact with the thin metal belt plate; and connective belt regions provided between the two metal belt plates in which the metal belt plates are absent. The connective belt regions being made of a synthetic resin or rubber to interconnect the two metal belt plates.

U.S. Pat. No. 5,330,267 to Willy Tauscher discloses a stationary fluid mixer in a flow conduit having at least two baffle plates secured to the wall of the conduit. The baffle plates are wider on the inside of the flow conduit than along the conduit wall, and they form an angle W of 10 degrees to 45 degrees relative to the main flow direction Z. The baffle plates can be given different orientations, and the projection FZ of the baffle plates in the main flow direction through the conduit is between 5 degrees to 30 degrees of the conduit cross-section F. This provides efficient mixing of the fluid in a simple manner.

U.S. Pat. No. 5,758,695 to Ken Carson teaches a hydraulically efficient ribbed pipe, wherein a pipe formed from a continuous, cold rolled, lock seam quality, sheet steel, and having a spiral rib. The pipe may be protected by an abrasion or corrosion resistant coating. The pipe is normally used for storm drains, culverts, sewer lines or HVAC. A closed spiral rib formed in the pipe wall adds strength to the wall, while maintaining a smooth inner wall that promotes exceptionally good fluid flow. The pipe has a smooth interior surface with outwardly projecting structural ribs of helical configuration throughout the length of the pipe.

U.S. Pat. No. 5,800,059 to Cooke, et al discloses a static mixer conduit comprising a longitudinally elongated conduit having tabs that are arranged with respective first edges adjacent the conduit wall, and respective opposed second edges that are spaced radially inwardly from the conduit wall. These tabs are operable as fluid foils so that with fluid flowing through the conduit, greater fluid pressures manifest against the tab's upstream faces relative to reduced fluid pressures against their downstream faces. The resultant pressure difference in the fluid adjacent, respectively, the mutually opposed faces of each of the tabs causes a longitudinal flow of fluid through the conduit over and past each said tab, to be redirected. As a result of that redirection, there is introduced a radial cross-flow component to the longitudinal flow of fluid through the conduit. In particular, the mixer further comprises a central body extending generally coaxially along at least a portion of the longitudinal extent of the conduit and defining between the central bodies surface and the conduit wall, an annular space confining the radial cross-flow. A method is also disclosed, which comprises static mixing, over a longitudinal extent of a mixing volume having an annular cross-section, wherein radial cross-stream mixing in a longitudinal fluid flow results from flow-redirecting tabs redirecting a longitudinal fluid flow from an outer, fluid containment boundary surface, across an intervening space having an annular cross-section towards an inner boundary surface.

In the past, I have used a process of twisting a length of polygonic tubing to produce an ornamental, decorative and non-functional metal work piece. The metal work was used for furniture, fence gates, lamps, table legs and the like. Although I have made, used and sold twisted lengths of polygonic tubing for ornamental, decorative and non-functional metal work pieces, I had no idea that the ornamental, decorative and non-functional metal work piece could be used as a mixing device or a separating device.

In my prior invention as set forth in U.S. patent application Ser. No. 10/167,791 filed Jun. 10, 2002, I set forth a novel static device for mixing matter flowing therethrough. The static device comprises a tube having a polygonic cross section defining a plurality of corners. The tube is spirally twisted with the plurality of corners forming a plurality of helixes for causing the matter flowing through the tube to rotate in accordance with the plurality of helixes. It is an object of the present intention to provide an alternative embodiment to my prior invention to include a center section of the spirally twisted tube formed in an arc having an arc center disposed normal to an axis of the twisted tube.

Another object of this invention is to provide an improved static mixing device which provides substantially reduced flow restriction to matter flowing through device when compared with the prior art.

Another object of this invention is to provide an improved static mixing device which provides a static mixing device.

Another object of this invention is to provide an improved static mixing device for thermally coupling with a container for heat transfer therebetween.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects and a full understanding of the invention may be had by referring to the summary of the invention, the detailed description setting forth the preferred embodiment in addition to the scope of the invention defined by the claims taken in conjunction with the accompanying drawings.

SUMMARY OF THE INVENTION

Specific embodiments of the present invention are shown in the attached drawings. For the purpose of summarizing the invention, the invention relates to an improved apparatus and method of making of an external static mixing device for mixing matter flowing therethrough. The device comprises a tube having a polygonic cross section defining a plurality of corners. The tube is spirally twisted with the plurality of corners forming a plurality of helixes for causing the matter flowing through the tube to rotate in accordance with the plurality of helixes.

In one embodiment of the invention, a static mixing device for mixing matter flowing therethrough comprises a tube having a polygonic cross section defining a plurality of corners about an axis. The tube has a first end and a second end section and a center section, and is spirally twisted about the axis with the plurality of corners forming a plurality of helixes. The plurality of helixes cause the matter flowing through the tube to rotate in accordance with the plurality of helixes. The center section of the spirally twisted tube is formed in an arc having an arc center disposed normal to the axis of the twisted tube.

In another embodiment of the invention, a static mixing device is described for mixing matter flowing therethrough. The tube has a first and a second tube section. The first and second tube sections have a polygonic cross-section about an axis defining a plurality of corners. The first tube section is spirally twisted in a first direction the second tube section is spirally twisted in a second direction. A coupling is provided for coupling the first tube section to the second tube section for causing the matter flowing through the first tube section to rotate in a first rotational direction and for causing the matter flowing through the second tube section to rotate in a second rotational direction. The spirally twisted tube has a first end and a second end section and a center section, with the center section of the spirally twisted tube formed in an arc having an arc center disposed normal to the axis of the twisted tube.

In another embodiment of the invention, a static mixing device is described wherein the arc comprises an arc having an included angle in the range of 0 to 360 degrees about the arc. In another embodiment of the invention, a static mixing device is described wherein the arc comprises an arc having an included angle greater than 360 degrees about the arc center. In another embodiment of the invention, a static mixing device is described wherein the arc comprises an arc having multiple turns and included angles greater than 360 degrees about the arc center for forming a helical arc.

In another embodiment of the invention, a static mixing device for a matter flowing therethrough is described. The static mixing device comprises a container, with a tube having a polygonic cross section defining a plurality of corners about an axis, and having a first end and a second end section and a center section. The tube is spirally twisted about the axis with the plurality of corners forming a plurality of helixes for causing the matter flowing through the tube to rotate in accordance with the plurality of helixes. The center section of the spirally twisted tube is formed in an arc comprising multiple arc turns having an arc center disposed normal to the axis of the twisted tube for forming a helical arc about the container.

The invention is also incorporated into the method of making a static device from a tube having a polygonic cross section, extending between a first and a second end about an axis, and having a first and a second end section and a center section. The method comprises the steps of filling the tube with a particulate material and rotating one of the first and second ends of the tube about the axis relative to the other of the first and second end of the tube to form a twisted tube. The center section of the twisted tube is then formed in an arc about an arc center disposed normal to axis of the twisted tube. The particulate material is then removed from the twisted tube.

In another embodiment, the invention is incorporated into the method of making a static device as previously described, wherein the formed circular arc comprises an arc in the range of 0 to 360 degrees of rotation of the twisted tube. In another embodiment, the invention is incorporated into the method of making a static device as previously described, wherein the formed circular arc comprises an arc in a range greater than 360 degrees of rotation of the twisted tube.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
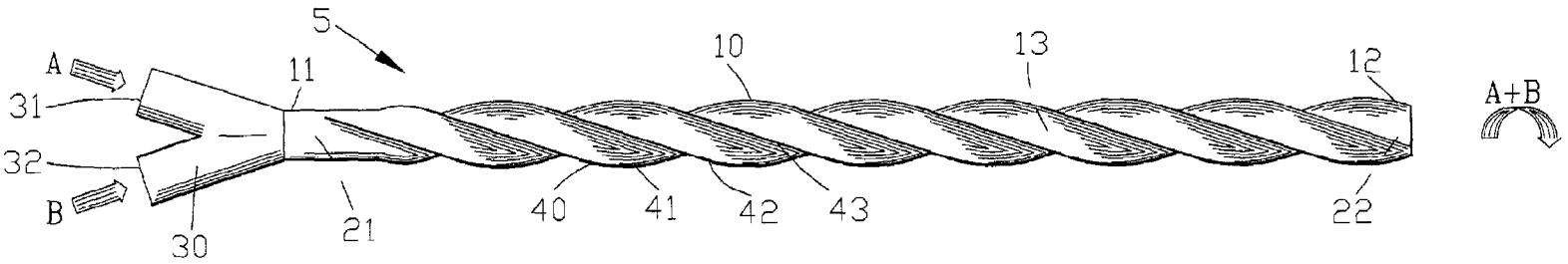
FIG. 1 is a side view of the static mixer incorporating the present invention.

FIG. 1 illustrates static mixer 5 of the present invention. The static mixer 5 comprises a tube 10 extending between a first and a second end 11 and 12 and defining an internal cross section 13.

The first and second ends 11 and 12 of the tube 10 define a first and a second port 21 and 22. A first and a second matter A and B enter the first port 21 to be mixed by the static mixer 5 to exit from the second port 22 as a mixture of the first and second matters A and B.

The first and second matters A and B may be a liquid, a gas or a solid material or a combination thereof. Preferably, one of the first and second matters A and B is a fluid for facilitating the movement of the first and second matters A and B through the tube 10 from the first end 11 to the second end 12.

In this example, the first port 21 comprises a Y member 30 having a first and a second input 31 and 32. The first and second matters A and B are directed through the first and second inputs 31 and 32 to enter the first port 21 of the tube 10. Although the first port 21 has been shown as a Y member 30 it should be understood that the first port 21 may take various configurations for directing the first and second matters A and B into the tube 10.

The first and second matters A and B entering the first port 21 of the tube 10 flow through the tube 10 to emerge from the second port 22 of the tube 10. As the first and second matters A and B flow through the tube 10 the static mixer 5 causes rotation of the first and second matters A and B. The rotation of the first and second matters A and B causes the first matter A to mix with the second matter B. The mixed first and second matters A and B is eluted from a second port 22 of the static mixer 5.

Figure 2:
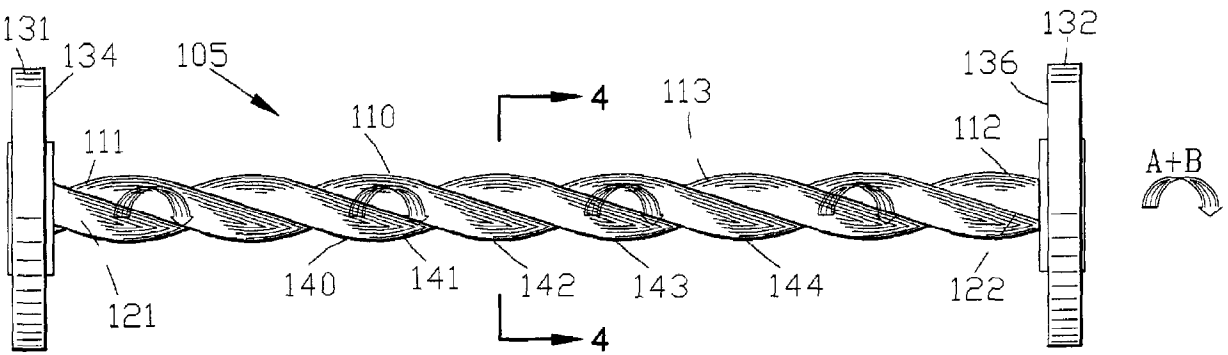
FIG. 2 is a side view of a first embodiment of a static mixing device of the present invention.
Figure 3:
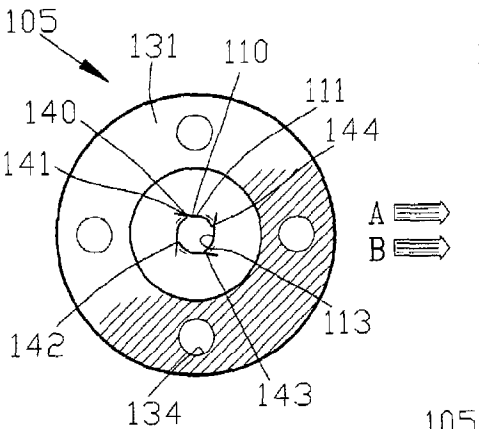
FIG. 3 is an end view of FIG. 2.
Figure 4:
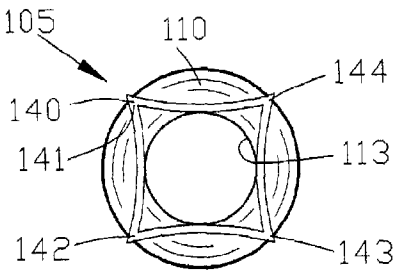
FIG. 4 is a section view through line 4-4 of FIG. 2.

FIGS. 2-4 illustrate a first embodiment of the static mixing device 105 of the present invention. The static mixing device 105 comprises a tube 110 extending between a first and a second end 111 and 112 and defining an internal polygonic cross section 113 defined by an inner wall surface 116 and an outer wall surface 118. The first and second ends 111 and 112 of the tube 110 define a first and a second port 121 and 122. Preferably, the tube 110 is formed using a cold twisting process, from a material having ductile characteristics. Preferably, the tube 110 is formed from a ductile metallic material such as carbon steel and alloys thereof. Additionally, various stainless steels and aluminum as well as copper, brass and bronze and alloys thereof may be utilized as the tube material. In the alternative, the tube 110 may be formed from plastic materials such as polyethylene and polypropylene that is heated to provide the desired ductile properties.

In this embodiment, a first and a second flanges 131 and 132 are affixed to the first and second ends 111 and 112 of the tube 110. Each of the first and second flanges 131 and 132 includes a plurality of bores 134 and 136 for securing the first and second ends 111 and 112 of the tube 110 to an external apparatus such as a piping system (not shown). In the alternative, the first and second flanges 131 and 132 enable a plurality of the static mixing devices 105 to be serially interconnected to form an extended unit. It should be appreciated by those skilled in the art that other forms of attaching may be used to affix the first and second ends 111 and 112 of tube 110 an external apparatus (not shown).

The internal polygonic cross section 113 of the tube 110 defines a plurality of corners 140. In this embodiment, internal polygonic cross section 113 of the tube 110 about an axis is shown as a generally square cross-section having a plurality of generally acute corners 141-144. Although the internal polygonic cross-section 113 has been shown as a generally square cross-section, it should be understood that the tube 110 may have various different types of cross-sections. Square metallic tubing having dimensions between 0.5×0.5 inches and 8×8 inches with thicknesses between 0.060 and 0.250 inches, as well as plastic square tubing having dimensions between 0.5×0.5 inches and 10×10 inches with thicknesses between 0.060 and 0.500 inches have been formed into the static mixing device 105.

An important aspect of the static mixing device 105 comprises the tube 110 being spirally twisted about an axis between the first and second ends 111 and 112 of tube 110. The plurality of corners 141-144 of the tube 110 define a plurality of helixes 150 shown as helixes 151-154 along the length of the tube 110. The tube 110 maintains the square cross section along the length of the tube 110 as shown in FIG. 4. The pitch of the tubing 110 is defined as the number of turns of a helix per foot of polygonic tubing. The pitch of the tubing 110 is directly dependent upon the desired degree of mixing. The pitch may vary in value between 0 and 5 turns per foot of length of tubing 110.

As the matter A and the matter B moves between the first and second ends 111 and 112 of tube 110, the plurality of helixes 151-154 impart a rotary motion to the flow of the matter A and the matter B in accordance with flow direction arrows. The plurality of helixes 151-154 impart a rotary motion about a central axis (not shown) extending along the length of the tube 110. The rotary motion of the matter A and the matter B reduces the laminar flow within tube 110 and promotes mixing of the matter A with the matter B as the matter A and B moves along the tube 110 between the first and second ends 111 and 112. The mixture of the matter A and B emerges from the second end 112 of the tube 10.

The turbulent flow produced in the static mixing device 105 through the plurality of helixes 150 provides a scrubbing action along the internal pipe wall, reducing or eliminating foreign material build-up within the pipe resulting from laminar flow and sedimentation. The lack of any internal structure within the mixing device 105 enables the mixing device 105 to be particularly applicable to the mixing of a wide variety of materials which may include both solid and liquid phases. Some typical examples include wastewater, including coagulants and flocculants, potable water and chlorine, paints and catalysts, clay slurries, and various pulps.

Figure 5:
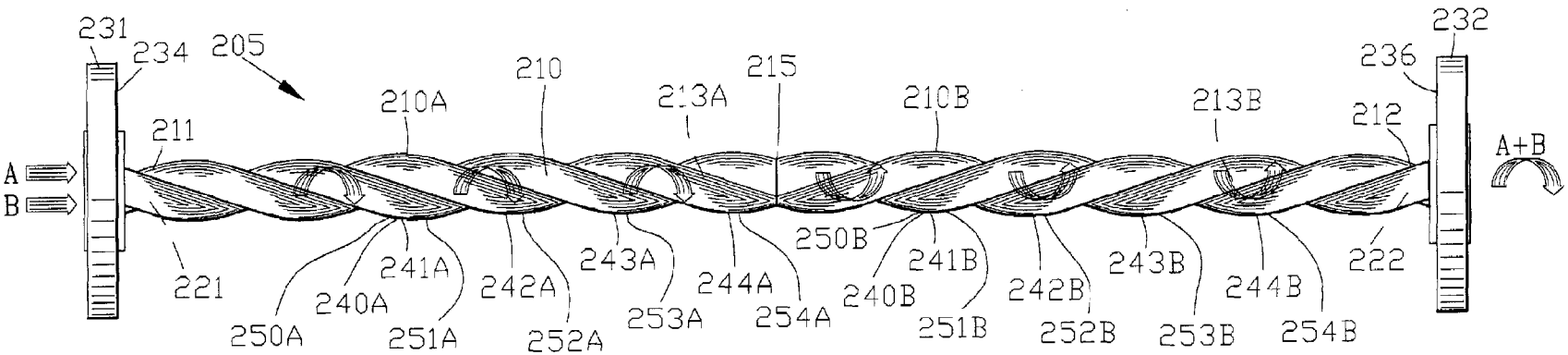
FIG. 5 is a side view of a second embodiment of the static mixing device of the present invention illustrating the reversing rotary direction of the fluid flow path.

FIG. 5 is a side view of a second embodiment of the static mixing device 205 of the present invention. The static mixing device 205 comprises a tube 210 extending between a first and a second end 211 and 212 and defining an internal polygonic cross section 213 defined by an inner wall surface 216 and an outer wall surface 218. The first and second ends 211 and 212 define a first and a second port 221 and 222. A first and a second flange 231 and 232 are affixed to the first and second ends 211 and 212 of the tube 210.

The tube 210 comprises tube sections 210A and 210B interconnected by a coupling 215. Each of the tube sections 210A and 210B comprises the internal polygonic cross section 213A and 213B. In this example, the tube section 210A has a plurality of corners 241A-244A defining a plurality of helixes 250 shown as helixes 251A-254A. The tube section 210B has a plurality of corners 241B-244B defining a plurality of helixes 251B-254B.

The rotational direction of the plurality of helixes 251A-254A of the tube section 210A is opposite to the rotational direction of the plurality of helixes 251B-254B of the tube section 210B. As the matter A and the matter B moves through the tube section 210A, the plurality of helixes 251A-254A impart a rotary motion to the flow of the matter A and the matter in accordance with flow direction arrow. As the matter A and the matter B moves through the tube section 210B, the plurality of helixes 251B-254B impart a rotary motion to the flow of the matter A and the matter B in accordance with flow direction arrow.

The plurality of helixes 251A-254A of the tube section 210A impart a rotary motion of the matter A and the matter B to reduce the laminar flow and to promote mixing of the matter A with the matter B within the tube section 210A. The plurality of helixes 251B-254B of the tube section 210B impart an opposite rotary motion of the matter A and the matter B to change the direction of the flow and to promote mixing of the matter A with the matter B within the tube section 210B.

The opposite rotary motion imparted to the matter A and the matter B between the tube sections 210A and 210B results in the creation of a substantial turbulence at the coupling 215. The substantial turbulence created at the coupling 215 provides substantial mixing of the matter A and the matter B. The mixture of the matter A and B emerges from the second end 212 of the tube 211. It should be understood that the pitch of the first section 210A may be greater than equal to or less than the pitch of the second section 210B.

Figure 6:
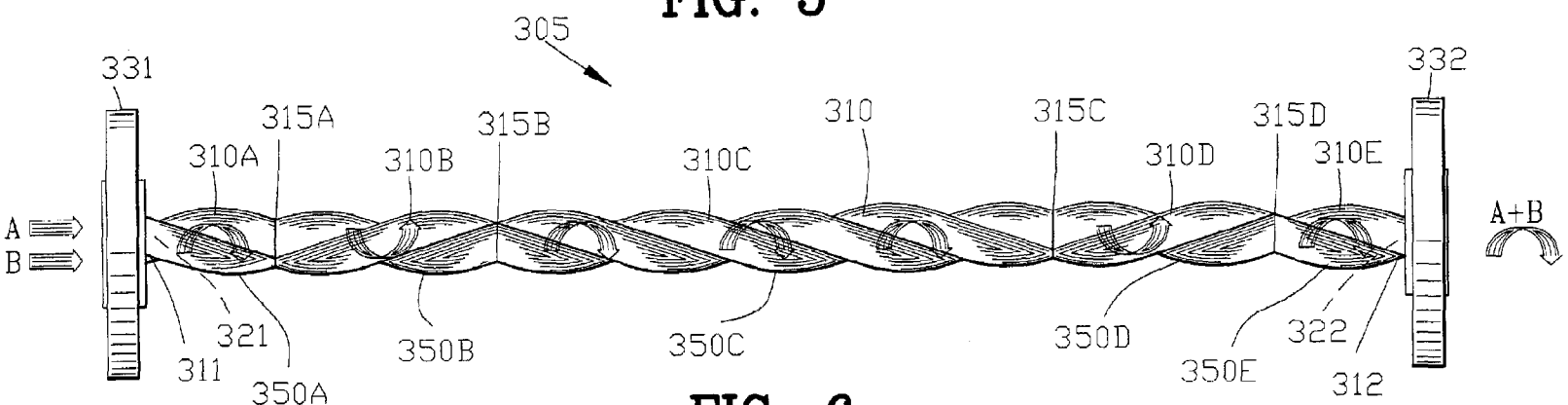
FIG. 6 is a side view of a third embodiment of the static mixing device of the present invention illustrating the multiple reversing rotary direction of the fluid flow path.

FIG. 6 is a side view of a third embodiment of the static mixing device 305 of the present invention. The static mixing device 305 comprises a tube 310 extending between a first and a second end 311 and 312 and defining an internal polygonic cross section 313. The first and second ends 311 and 312 define a first and a second port 321 and 322. A first and a second flange 331 and 332 are affixed to the first and second ends 311 and 312 of tube 310.

The tube 310 comprises tube sections 310A-310D interconnected by a coupling 315A-315E. Each of the tube sections 310A and 310E comprises the internal polygonic cross section 313 defining a plurality of helixes 350A-350E.

The rotational direction of the plurality of helixes 350A, 350C and 350E of the tube sections 310A, 310C and 310E is opposite to the rotational direction of the plurality of helixes 350B and 350D of the tube sections 310B and 310D.

As the matter A and the matter B moves through the tube sections 310A, 310C and 310E, the plurality of helixes 350A, 350C and 350E impart a rotary motion to the flow of the matter A and the matter B in accordance with flow direction arrow. As the matter A and the matter B moves through the tube sections 310B and 310D, the plurality of helixes 350B and 350D impart an opposite rotary motion to the flow of the matter A and the matter B in accordance with flow direction arrow.

The opposite rotary motion imparted to the matter A and the matter B at the coupling 315A-315D results in the creation of a substantial turbulence at the coupling 315A-315D. The substantial turbulence created at the coupling 315A-315D provides substantial mixing of the matter A and the matter B. The mixture of the matter A and B emerges from the second end 312 of the tube 310.

The length of the tube sections 310A and 310E adjacent the first and second ends 311 and 312 are shorter than the length of the adjacent tube sections 310B and 310D. The length of the central tube sections 310C is longer than the length of the tube sections 310B and 310D. The arrangement of the shorter length tube sections 310A and 310E and the tube sections 310B and 310D adjacent to the first and second ends 311 and 312, provides substantial mixing of the matter A and the matter B.

Figure 7:
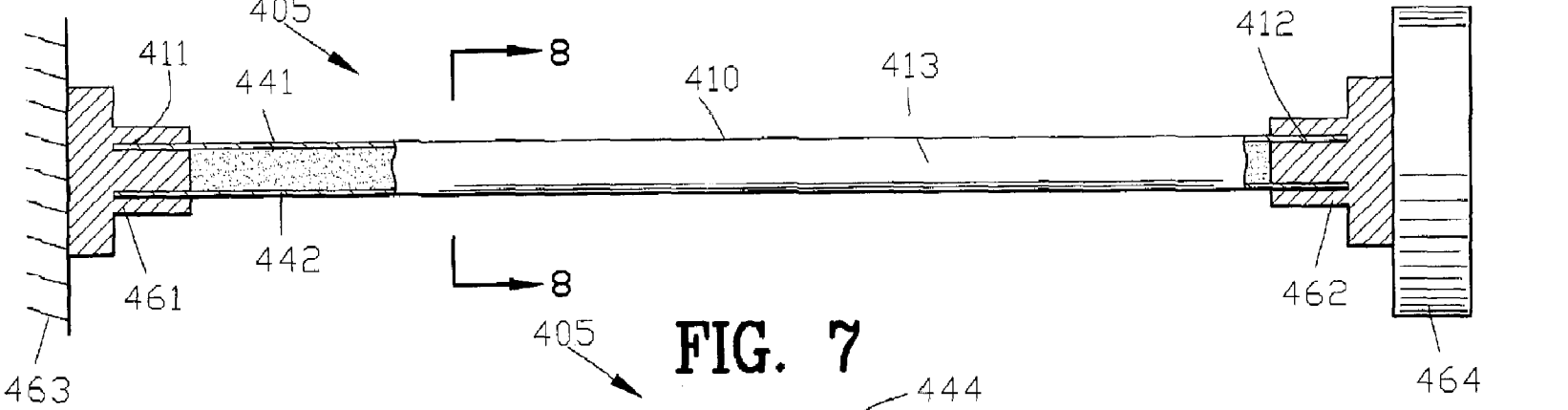
FIG. 7 illustrates a first step in the method of making a static device showing a section of tubing installed on a twisting apparatus.

FIG. 7 illustrates a first step in the method of making a static device 405 showing a section of tubing 410 extending between a first and a second end 411 and 412 and defining an internal polygonic cross section 413 defined by an inner wall surface 416 and an outer wall surface 418. In this example, the tubing 410 is shown as a ductile metallic material.

Figure 8:
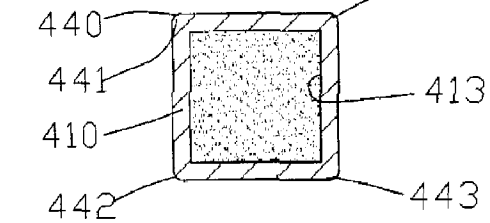
FIG. 8 is a section view through line 8-8 of FIG. 7.

FIG. 8 is a section view through line 8-8 of FIG. 7 illustrating the polygonic cross section 413 of the tubing 410. The tubing 410 is filled with a particulate material 416 which is a substantially flowable and a substantially incompressible material such as sand or the like. In this example, the polygonic cross section 413 of the tubing 410 is illustrated as square tubing having four corners 441-444.

The tubing 410 is shown installed in a twisting apparatus 460. The first end 411 of the tubing 410 is inserted into first collet 461 whereas the second end 412 of the tubing 410 is inserted into a second collet 462. The first collet 461 is affixed to a fixed support 463 whereas the second collet 462 is affixed to a rotatable collet mount 464.

Figure 9:
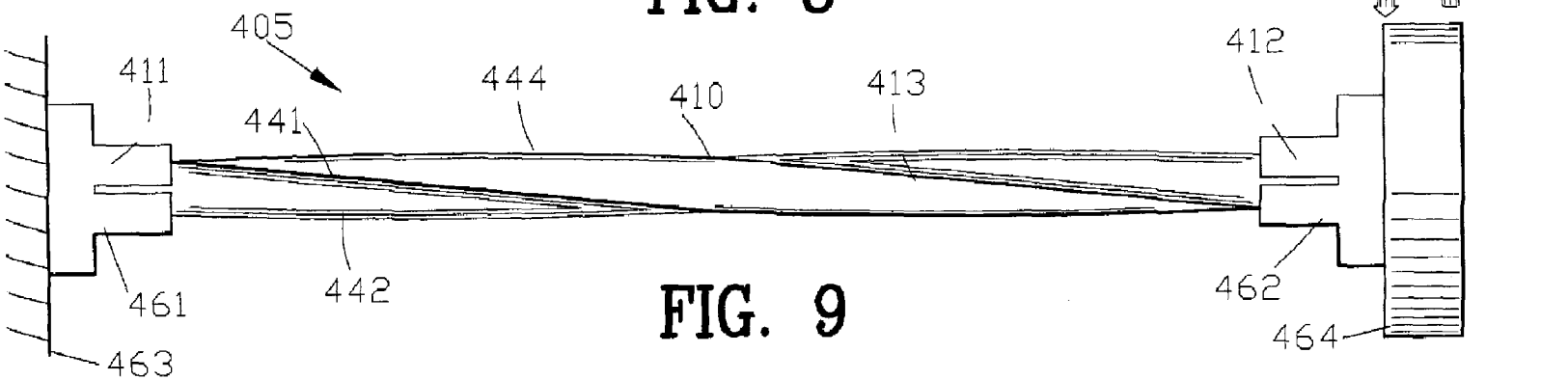
FIG. 9 illustrates a second step in the method of making a static device showing the beginning of a twisting operation.

FIG. 9 illustrates a second step in the method of making a static device 405 showing the beginning of a twisting operation. The second collet 462 is rotated by the rotatable collet mount 464. The continued rotation of the second end 412 of the tube 410 relative to the first end 411 of the tube 410 initially forms a uniform twist in the tube 410.

Figure 10:
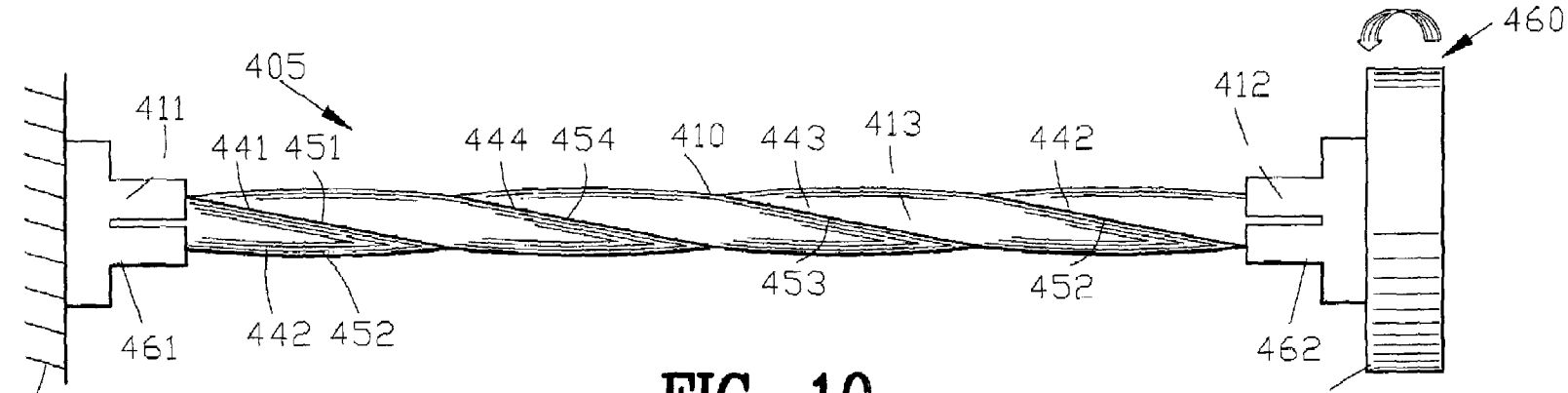
FIG. 10 illustrates a third step in the method of making a static device showing the continued twisting operation.

FIG. 10 illustrates a third step in the method of making the static device 405 showing the continued twisting operation. The rotation of the second end 412 relative to the first end 411 of the tube 410 forms a plurality of helixes 451-454 from each of the corners 441-444 of the tubing 410.

Figure 11:
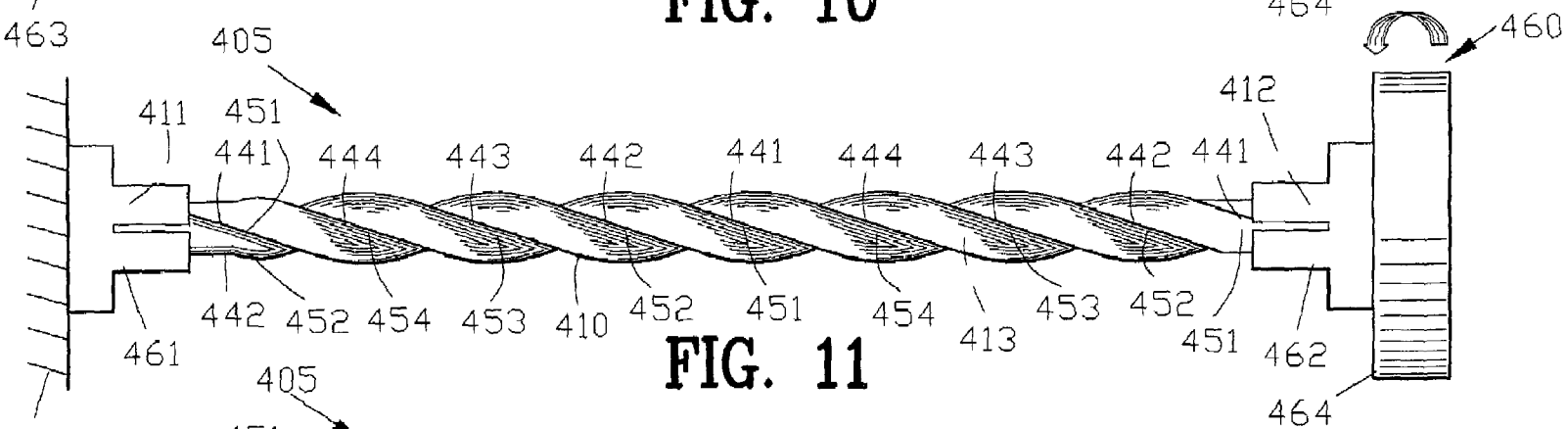
FIG. 11 illustrates a fourth step in the method of making a static device showing the completed twisting operation.

FIG. 11 illustrates a fourth step in the method of making the static device 405 showing the completed twisting operation. The number of rotations of the second end 412 relative to the first end 411 of the tube 410 determines the pitch of the plurality of helixes 451-454.

Figure 12:
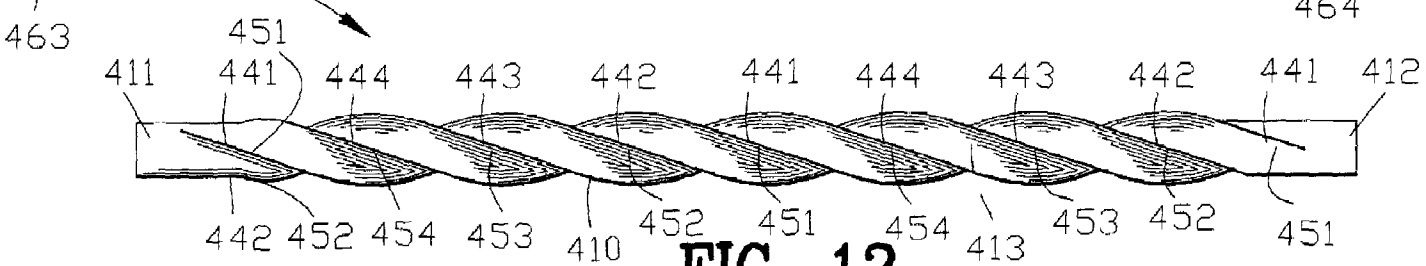
FIG. 12 illustrates a fifth step in the method of making a static device showing the removal of the twisted tubing from the twisting apparatus.

FIG. 12 illustrates a fifth step in the method of making a static device 405 showing the removal of the twisted tubing 405 from the twisting apparatus 460. After the tube 410 is removed from the first and second collets 461 and 462, the particulate material 416 is removed from the interior of the tube 410.

Figure 14:
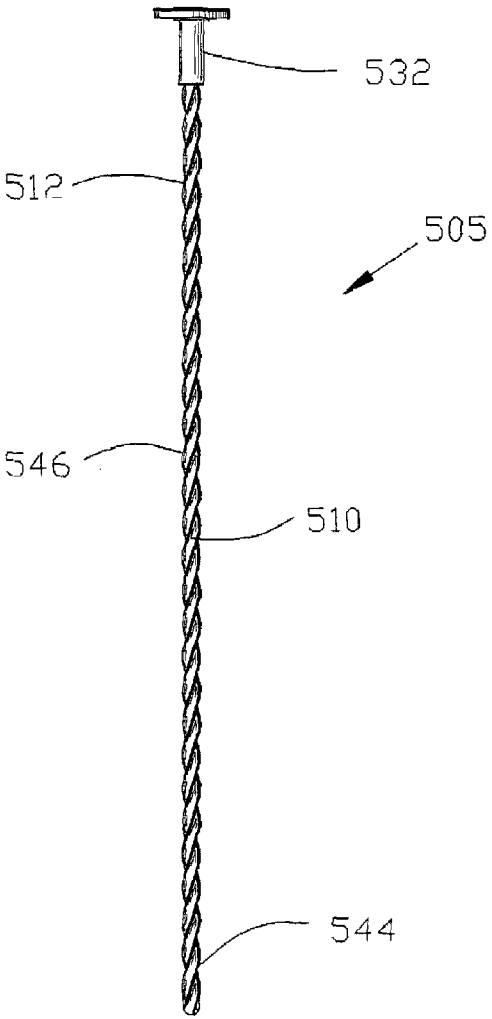
FIG. 14 illustrates a side view of the twisted tube of FIG. 13.
Figure 13:
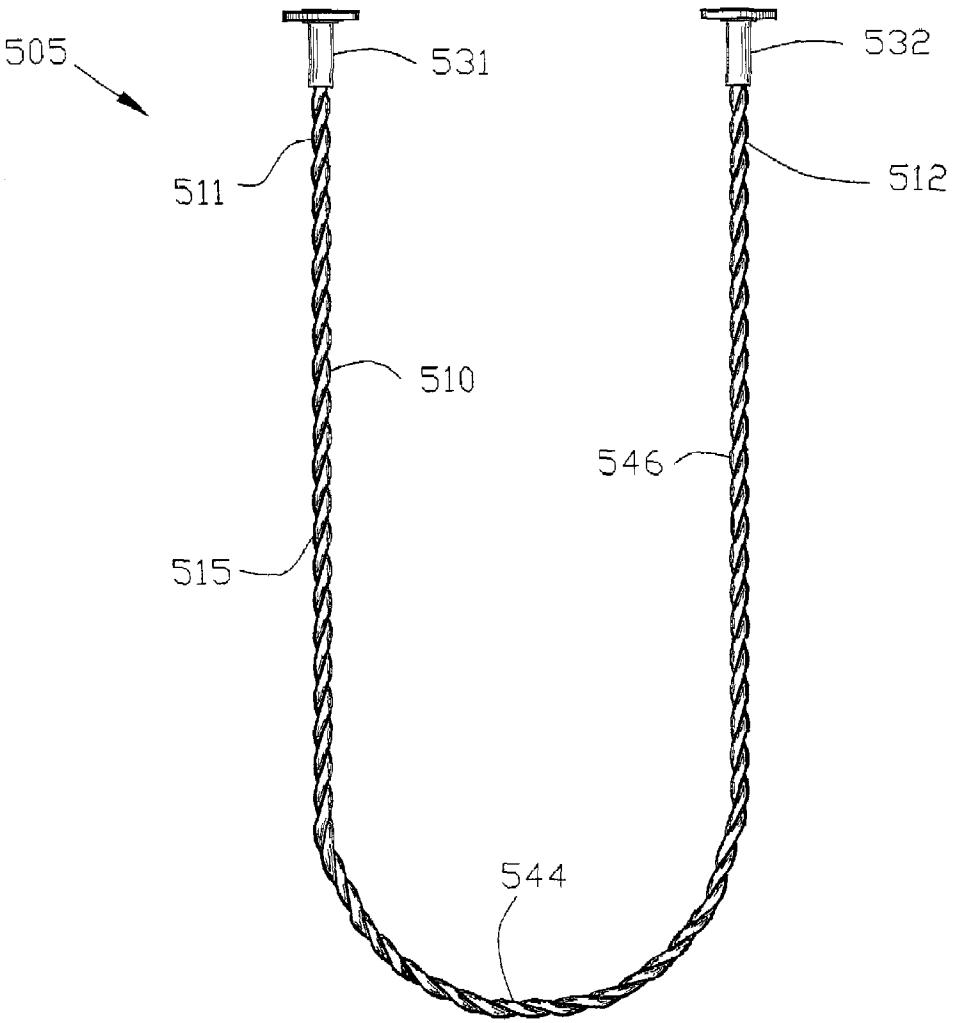
FIG. 13 illustrates a fourth embodiment of the static mixing device of the present invention comprising a center section of the twisted tube formed in an arc.

FIGS. 13 and 14 illustrate a fourth embodiment of the static mixing device 505 of the present invention. The static mixing device 505 comprises a tube 510 extending between a first and a second end 511 and 512. Tube 510 is spirally twisted about an axis as described in FIGS. 1-12. A first and a second flange 531 and 532 are affixed to the first and second ends 511 and 512 of tube 510. Each of the first and second flanges 531 and 532 includes a plurality of bores 534 and 536 for securing the first and second ends 511 and 512 of the tube 510 to an external apparatus such as a piping system (not shown). In the alternative, the first and second flanges 531 and 532 enable a plurality of the static mixing devices 505 to be serially interconnected into a unit. It should be appreciated by those skilled in the art that other forms of attaching may be used to affix the first and second ends 511 and 512 of tube 510 to an external apparatus (not shown), or to a second tube 510.

Tube 510 comprises a first section 515, a second section 544 and a third section 546. In this embodiment, the first and third sections 515 and 546 are shown as straight sections. The second or center section 544 is illustrated as an arc having an arc center disposed normal to the axis of the twisted tube. In this embodiment of the invention, the second or center section 544 is shown having an included arc angle of 180 degrees forming a substantially "U" shaped configuration. However, it should be understood that the second or center section 544 may have an included arc angle between 0 and 360 degrees.

Figure 16:
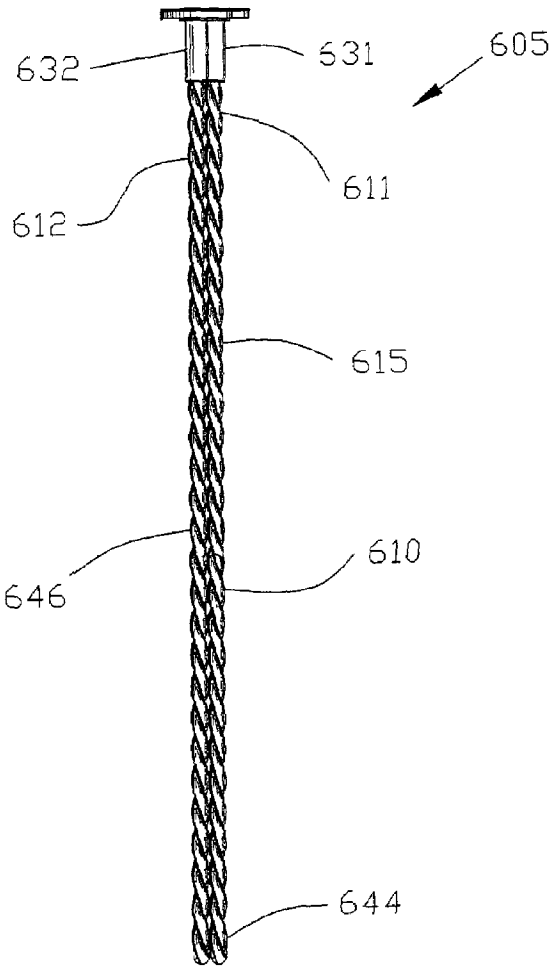
FIG. 16 illustrates a side view of the twisted tube of FIG. 15.
Figure 15:
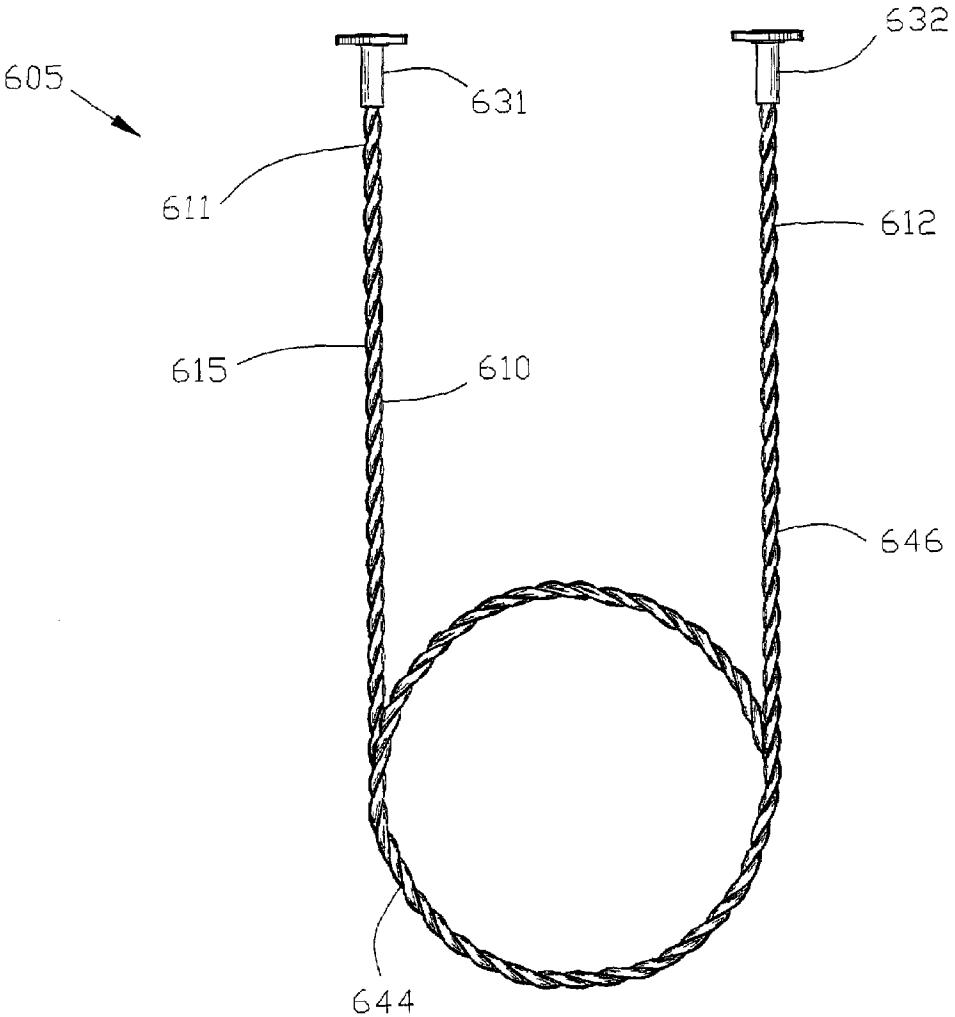
FIG. 15 illustrates a fifth embodiment of the static mixing device of the present invention comprising a center section of the twisted tube formed in an arc.

FIGS. 15 and 16 illustrate a fifth embodiment of the static mixing device 605 of the present invention. The static mixing device 605 comprises a tube 610 extending between a first and a second end 611 and 612. The tube 610 is spirally twisted about an axis as described in FIGS. 1-12. A first and a second flange 631 and 632 are affixed to the first and second ends 611 and 612 of the tube 610. Each of the first and second flanges 631 and 632 includes a plurality of bores 634 and 636 for securing the first and second ends 611 and 612 of the tube 610 to an external apparatus such as a piping system (not shown). In the alternative, the first and second flanges 631 and 632 enable a plurality of the static mixing devices 605 to be serially interconnected into an extended unit. It should be appreciated by those skilled in the art that other forms of attaching may be used to affix the first and second ends 611 and 612 of the tube 610 to an external apparatus (not shown), or to a second tube 610.

The tube 610 comprises a first section 615, a second section 644 and a third section 646. In this embodiment, the first and third sections 615 and 646 are shown as straight sections and the second or center section 644 is illustrated as an arc having an arc center disposed normal to the axis of the twisted tube. In this embodiment of the invention, the second or center section 644 is shown having an included arc angle greater than 360 degrees forming a single turn coil configuration. However, it should be understood that the second or center section 544 may be formed in a multiple turn coil configuration.

The inclusion of circular section 644 permits a substantial increase in the linear length of the tube 610 within a substantially equivalent space as occupied by the previously described "U" configuration of FIGS. 13 and 14. Additionally, the addition of the circular center section 644 provides relief of vibration and flexure induced failures of the tube 610.

Figures 17, 18:
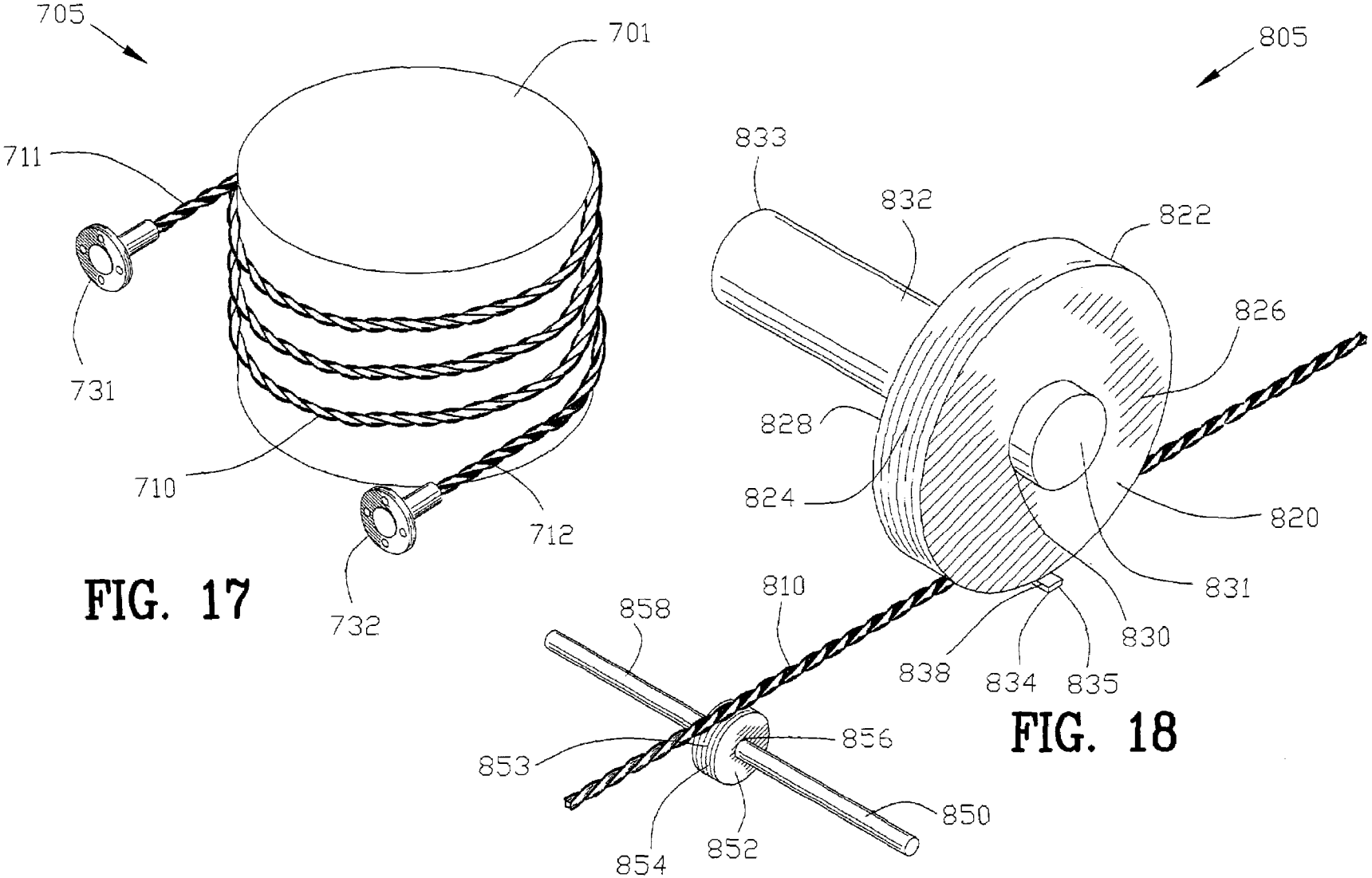
FIG. 17 illustrates a sixth embodiment of the static mixing device of the present invention comprising a twisted tube helically wound about a container.
FIG. 18 illustrates an apparatus for forming the arc in the center section of the twisted tube as shown in FIGS. 13 and 14.

FIG. 17 illustrates a sixth embodiment of the static mixing device 705 of the present invention. The static mixing device 705 comprises a tube 710 extending between a first and a second end 711 and 712. The tube 710 is helically wound about a container 701, such as a cylindrical object, tank or the like. The tube 710 is spirally twisted about an axis as described in FIGS. 1-12. A first and a second flange 731 and 732 are affixed to the first and second ends 711 and 712 of the tube 710. Each of the first and second flanges 731 and 732 includes a plurality of bores 734 and 736 for securing the first and second ends 711 and 712 of the tube 710 to an external apparatus (not shown).

In this embodiment of the invention, the tube 710 is formed in a helix to be thermally coupled to the container 701. The helically formed tube 710 is affixed about the container 701 to provide a variety of advantages. Firstly, a substantial linear length of the tube 710 may be affixed about the container 701 while occupying substantially the space as the container 701. Secondly, heat transfer is substantially enhanced between the helically formed tube 710 and the container 701.

Figure 19:
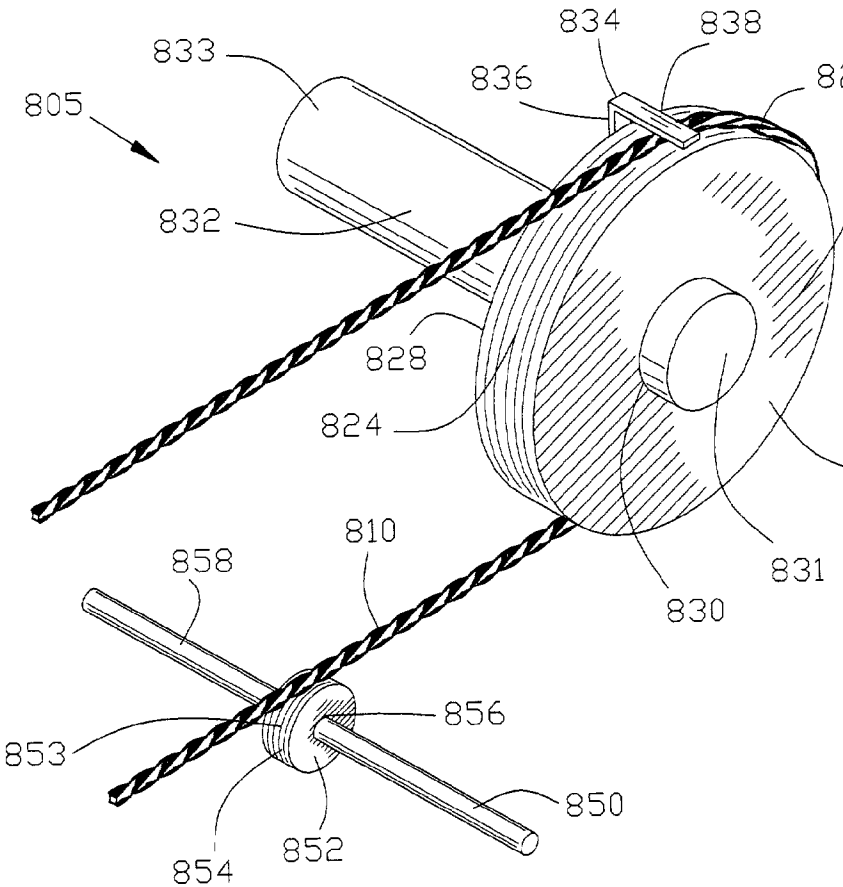
FIG. 19 illustrates the apparatus of FIG. 18 forming an arc less than 360 degrees in the center section of the twisted tube as shown in FIGS. 13 and 14.

FIGS. 18 and 19 illustrate an apparatus 805 for forming the arc section in the twisted tube 510 of FIGS. 13 and 14. The apparatus 805 comprises a forming assembly 820 and a guide assembly 850. The forming assembly 820 comprises a substantially cylindrical mandrel 822 having an annular surface 824 defined between a first and a second circular end surface 826 and 828. The annular surface 824 of the mandrel 822 may be grooved for receiving the tube 810. An axial bore 830 is provided in the mandrel 822 for affixedly mounting the mandrel 822 to a first end 831 of mandrel drive shaft 832.

A retaining bar 834 has a first and a second section 836 and 838, wherein the first section 836 being substantially normal to the second section 838. The first section 836 of the retaining bar 834 is radially affixed to the second circular end surface 828 of the mandrel 822 such that the second section 838 of the retaining bar 834 is parallel to and extends over the annular surface 824 of the mandrel 822. The distance between the second section 838 of the retaining bar 834 and the annular surface 824 of the mandrel 822 is adjusted to provide clearance for the insertion of the tube 810 therebetween. The second end 833 of the mandrel drive shaft 832 is affixed to a mechanical device for rotating the drive shaft 832.

The guide assembly 850 comprises a substantially cylindrical guide wheel 852 having an annular surface 854 with an annular groove 853 therein for receiving the tube 810. An axial bore 856 is provided in the guide wheel 852 for mounting the guide wheel 852 to a guide wheel shaft 858. The guide wheel 852 may be rotatably mounted on the guide wheel shaft 858.

FIG. 18 illustrates a first position of the mandrel 822 with the retaining bar 834 being located in a first position 835. The tube 810 is inserted between the mandrel 822 and the second section 838 of the retaining bar 834. The tube 810 is positioned such that the beginning of the arc section of the tube 810 being coincident with the second section 838 of the retaining bar 834.

FIG. 19 illustrates a second position of the mandrel 822 with the retaining bar 834 being located in a second position 837. The mandrel 822 has been rotated in a counterclockwise direction thereby forming an arc in the tube 810. Although the arc illustrated in FIG. 19 is approximately 180 degrees, it should be understood that the apparatus 805 is capable of forming arcs greater and less than 180 degrees. After the static mixing device 810 is removed from the apparatus 805, the particulate matter 816 is removed from the tube 810.

Figure 20:
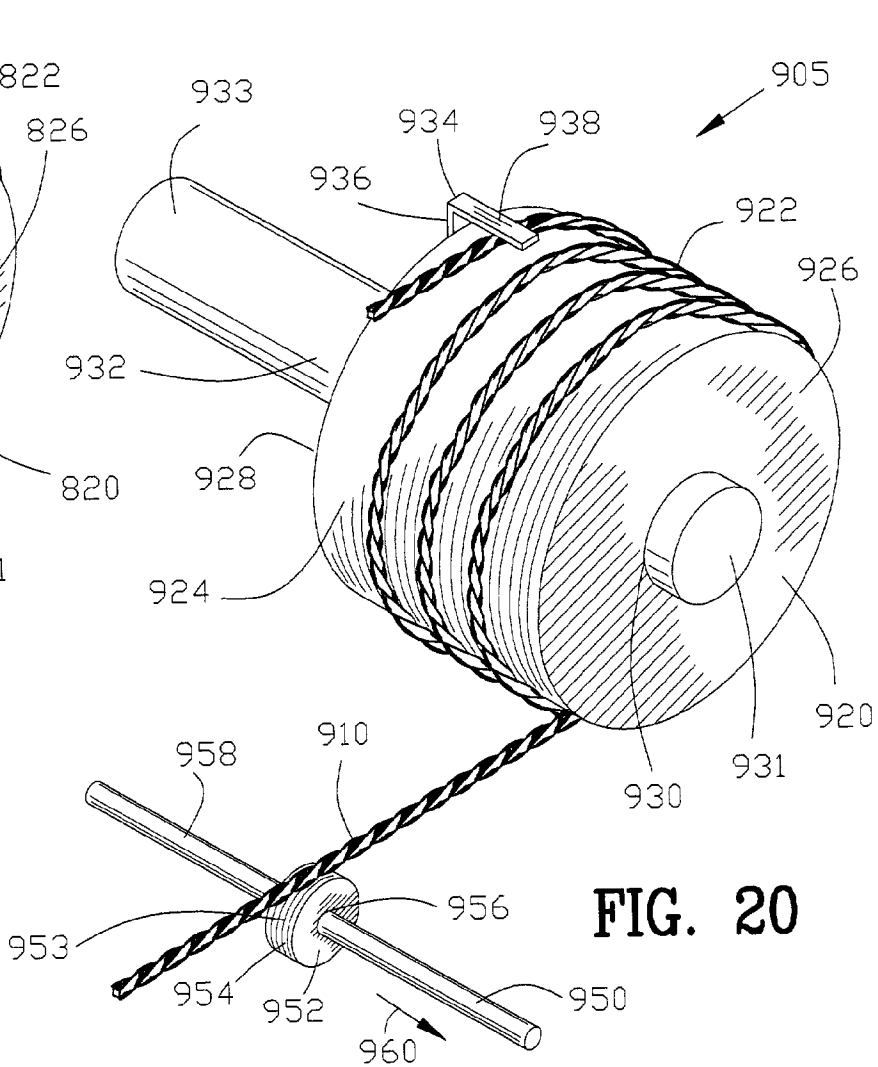
FIG. 20 illustrates an apparatus for forming an arc greater than 360 degrees or a helical arc in the twisted tubes as shown in FIGS. 15-17.

FIG. 20 illustrates an apparatus 905 for forming the helical arc in the twisted tube 910 of FIG. 17. The apparatus 905 comprises a forming assembly 920 and a guide assembly 950. The forming assembly 920 comprises a substantially cylindrical mandrel drum 922 having an annular surface 924 defined between a first and a second circular end surface 926 and 928. The annular surface 924 of the mandrel drum 922 may be helically grooved for receiving the tube 910. An axial bore 930 is provided in the mandrel drum 922 for affixedly mounting the mandrel drum 922 to a first end 931 of the mandrel drive shaft 932. A retaining bar 934 has a first and a second section 936 and 938 with the first section 936 being substantially normal to the second section 938. The first section 936 of the retaining bar 934 is radially affixed to the second circular end surface 928 of the mandrel drum 922 such that the second section 938 of the retaining bar 934 is parallel to and extends over a portion of the annular surface 924 of the mandrel drum 922. The distance between the second section 938 of retaining bar 934 and the annular surface 924 of the mandrel drum 922 is adjusted to provide clearance for the insertion of tube 910 therebetween. The second end 933 of the mandrel drive shaft 932 is affixed to a mechanical device for rotating the drive shaft 932.

The guide assembly 950 comprises a substantially cylindrical guide wheel 952 having an annular surface 954 with an annular groove 953 therein for receiving the tube 910. An axial bore 956 is provided in the guide wheel 952 for affixedly mounting the guide wheel 952 to a guide wheel shaft 958. The guide wheel shaft 958 is provided with a mechanism (not shown) for axial movement of the guide wheel shaft 958 and hence the guide wheel 952 affixed thereto.

The mandrel 922 is positioned with the retaining bar 934 being located in a first position similar to that illustrated in FIG. 18. The tube 910 is inserted between the mandrel 922 and the second section 938 of the retaining bar 934. The tube 910 is positioned of such that the beginning of the arc section is coincident with the second section 938 of the retaining bar 934 and simultaneously positioned within the groove 953 in the annular surface 954 of the guide wheel 952.

The mandrel 922 is rotated in a counterclockwise direction thereby forming an arc in the tube 910. Concurrent with the counterclockwise rotation of the mandrel 922, the guide wheel shaft 958 and the guide wheel 952 axially move in a first direction 960. The axial movement of the guide wheel 952 combined with the counterclockwise rotation of the mandrel 922 causes the tube 910 to be formed into a helix about the mandrel 922. Although FIG. 20 illustrates an helix arc of approximately three and one half revolutions, it should be understood that the apparatus 905 is capable of forming arcs greater and less than three and one half revolutions. After the static device 910 is removed from the apparatus 905, the particulate matter 916 is removed from the tube 910.

It should be understood by those skilled in the art that although the foregoing description referred to pressure applied to the inlet in order to effect the movement of material within the static device, movement of material may also be effected by the application of a vacuum or reduced pressure applied to the outlet of the static device.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A static mixing device for mixing matter flowing therethrough comprising:

a tube having a first and a second tube section;

each of said first and second tube sections having a substantially square cross section defining a plurality of corners;

said first tube section being spirally twisted in a first direction with said plurality of corners of said substantially square cross section forming a plurality of helixes for causing the matter flowing through said first tube section to rotate in a first rotational direction;

said second tube section being spirally twisted in a second direction opposite to said first direction of said first tube section with said plurality of corners of said substantially square cross section forming a plurality of helixes for causing the matter flowing through said second tube section to rotate in a second rotational direction;

a coupling for coupling said first tube section to said second tube section for causing the matter flowing through said first tube section to rotate in said first rotational direction and for causing the matter flowing through said second tube section to change direction to rotate in said second rotational direction; and a central section of said spirally twisted tube being formed in an arc having an arc center disposed normal to said axis of said tube.

2. A static mixing device for mixing a first and a second matter flowing therethrough, comprising:

a tube having a first tube section, a second tube section and a third tube section;

each of said first, second and third tube sections having a square cross section defining a plurality of corners;

said first tube section being spirally twisted in a first direction with said plurality of corners of said square cross section forming a plurality of helixes for causing the matter flowing through said first tube section to rotate in a first rotational direction;

said second tube section being spirally twisted in a second direction with said plurality of corners of said square cross section forming a plurality of helixes for causing the matter flowing through said second tube section to rotate in a second rotational direction;

said third tube section being spirally twisted in said first direction with said plurality of corners of said square cross section forming a plurality of helixes for causing the matter flowing through said third tube section to rotate in said first rotational direction;

couplings for coupling said second tube section between said first tube section and said third tube section for causing the matter flowing through said first tube section to rotate in said first rotational direction and to change direction for causing the matter flowing through said second tube section to rotate in said second rotational direction and to change direction for causing the matter flowing through said third tube section to rotate in a first rotational direction; and a central section including said second tube section of said spirally twisted tube being formed in an arc having an arc center disposed normal to said axis of said tube.

3. A static mixing device for mixing matter flowing therethrough comprising:

a tube having a first tube section, a second tube section and a third tube section;

a Y member having a first and a second input connected to said first tube section for introducing the first and second matter into said first tube section;

each of said first, second and third tube sections having a generally square cross section defining a plurality of generally acute corners;

said first tube section being spirally twisted in a first direction with said plurality of corners forming a plurality of helixes for causing the matter flowing through said first tube section to rotate in a first rotational direction;

said second tube section being spirally twisted in a second direction with said plurality of corners forming a plurality of helixes for causing the matter flowing through said second tube section to rotate in a second rotational direction;

said third tube section being spirally twisted in said first direction with said plurality of corners forming a plurality of helixes for causing the matter flowing through said third tube section to rotate in said first rotational direction;

couplings for coupling said second tube section between said first tube section and said third tube section for causing the matter flowing through said first tube section to rotate in said first rotational direction and to change direction for causing the matter flowing through said second tube section to rotate in said second rotational direction and to change direction for causing the matter flowing through said third tube section to rotate in a first rotational direction; and a central section including said second tube section of said spirally twisted tube being formed in an arc having an arc center disposed normal to said axis of said tube.

* * * * *